US006585251B2

(12) United States Patent
Allen et al.

(10) Patent No.: US 6,585,251 B2
(45) Date of Patent: Jul. 1, 2003

(54) ARTICULATING SEPARATOR

(75) Inventors: Robert J. Allen, Shelton, CT (US); Eric A. Belec, Southbury, CT (US); Michael M. Farrell, Beacon Falls, CT (US)

(73) Assignee: Pitney Bowes Inc., Stamford, CT (US)

( * ) Notice: Subject to any disclaimer, the term of this patent is extended or adjusted under 35 U.S.C. 154(b) by 67 days.

(21) Appl. No.: 10/011,687

(22) Filed: Nov. 13, 2001

(65) Prior Publication Data

US 2003/0090051 A1 May 15, 2003

(51) Int. Cl.[7] ..... B65H 3/52; B65H 3/43; B65H 3/34

(52) U.S. Cl. ..... 271/121; 271/104; 271/137; 271/167

(58) Field of Search ..... 271/121, 104, 271/137, 167, 124; B65H 3/52, 3/43, 3/34

(56) References Cited

U.S. PATENT DOCUMENTS 4,083,555 A * 4/1978 Irvine et al. ..... 271/10.13
4,848,762 A 7/1989 Beery ..... 271/19
4,930,764 A 6/1990 Holbrook et al. ..... 271/119
4,973,037 A 11/1990 Holbrook ..... 271/2
5,004,218 A 4/1991 Sardano et al. ..... 271/35
5,011,124 A * 4/1991 Sardano et al. ..... 271/35
5,112,037 A 5/1992 Holbrook ..... 271/2
5,125,214 A 6/1992 Orsinger et al. ..... 53/460
5,201,508 A * 4/1993 Kuo ..... 271/10.03
5,203,846 A * 4/1993 Kuhns et al. ..... 271/125
5,431,385 A * 7/1995 Holbrook ..... 271/122
6,003,857 A 12/1999 Salomon et al. ..... 271/122
6,244,587 B1 * 6/2001 Hermander ..... 271/34

FOREIGN PATENT DOCUMENTS

JP 60-56746 * 4/1985 ..... B65H/3/06

* cited by examiner

*Primary Examiner*—Donald P. Walsh
*Assistant Examiner*—Kenneth W Bower
(74) *Attorney, Agent, or Firm*—Steven J. Shapiro; Angelo N. Chaclas

(57) ABSTRACT

A separator includes a housing, a feeder mounted in the housing for feeding documents along a feed path and a retard mechanism mounted in the housing along the feed path and opposite to the feeder. The retard mechanism includes a body and a pad attached to the body. The body is mounted at first and second pivot points such that the body and pad can rotate around the first and second pivot points.

11 Claims, 6 Drawing Sheets

ARTICULATING SEPARATOR

FIELD OF THE INVENTION

The instant invention relates to separator devices used in document handling systems for separating individual documents from a stack of documents. More particularly, the instant invention pertains to a separator device mounted for movement in a manner that increases surface contact between the retard mechanism of the separator and the processed documents thereby ensuring more effective separation of individual documents from the stack.

BACKGROUND

The processing and handling of documents automatically and reliably at high speeds is very important for many business organizations. For example, in a typical corporation large volumes of mailpieces may be generated and received on a daily basis. These mailpieces may include single sheets, envelopes, flats, booklets, magazines, catalogues, advertisements and postcards; all of which may have a different size, thickness, weight, and material characteristic. Whether these mailpieces are being sent out or inducted at a mailroom facility, they are all typically collected, sorted, and processed prior to delivery to their final destination. Since many of these mailpieces may be critical to the organization (i.e. payments received) the reliable and timely delivery of mailpieces is quite important.

High-speed mailing and sorting machines have been developed with the capability to some extent of processing mixed types of mailpieces. Typically these high-speed devices have an input hopper into which a stack of mixed mail is placed. The stack of mixed mail is fed, often in shingled form, to a separator, which has the critical function of separating individual mailpieces from the stack so that the individual mailpieces are fed seriatim downstream in the high-speed device for subsequent processing. The conventional separator accomplishes the separating function primarily through the use of two major components, a retard mechanism and a feeder. The feeder applies a feed force to the stack tending to move the stack downstream while the retard mechanism applies a retard force in opposition to the feed force. In a properly functioning separator, the fine-tuning of these forces results in effective mailpiece separation.

Unfortunately, the fine-tuning of the above-discussed forces becomes increasingly complex when mixed types of mail are being processed. That is, the necessary retard force needed to separate and feed thick mailpieces may result in damage to very thin mailpieces. Conversely, if the retard force is set too low, multiple documents may be fed through the separator at the same time. Due to the above problems, operators of these high-speed devices often perform a manual presort of the mailpieces to create more uniform stacks of mailpieces for processing. As each stack is processed, manual adjustments are made to the separator to obtain the force profile required for the effective separation of the type of mailpieces in each stack. Naturally, the presorting and manual adjustment requirements slow down the processing of the mailpieces considerably.

Further, in many separators the retard mechanism is an active device such as a plurality of belts driven in opposition to the drive direction of the feeder. These active retard mechanisms require a drive system, which adds additional cost and complexity to the retard mechanism.

Therefore, what is needed is a separator that effectively separates individual mailpieces from a stack of uniform or mixed types of mail. Further, the separator should have a passive retard mechanism and be self-adjusting to accommodate various thickness mailpieces.

SUMMARY OF THE INVENTION

A separator includes a housing, a feeder mounted in the housing for feeding documents along a feed path and a retard mechanism mounted in the housing along the feed path and opposite to the feeder. The retard mechanism includes a body and a pad attached to the body. The body is mounted at first and second pivot points such that the body and pad can rotate around the first and second pivot points.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

The accompanying drawings, which are incorporated in and constitute a part of the specification, illustrate a presently preferred embodiment of the invention, and together with the general description given above and the detailed description of the preferred embodiment given below, serve to explain the principles of the invention.

Figure 1:
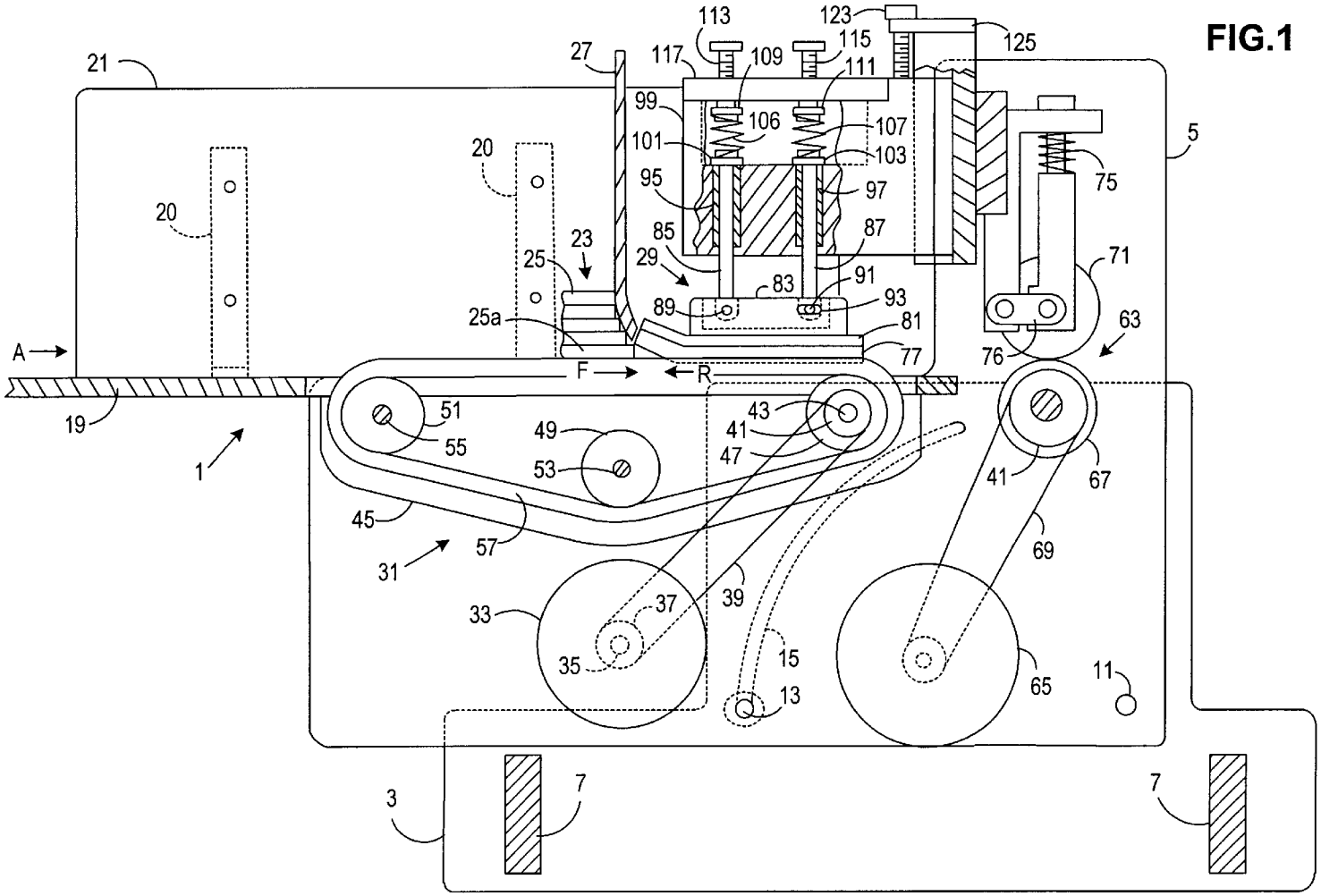
FIG. 1 is side view of the separator.
Figure 2:
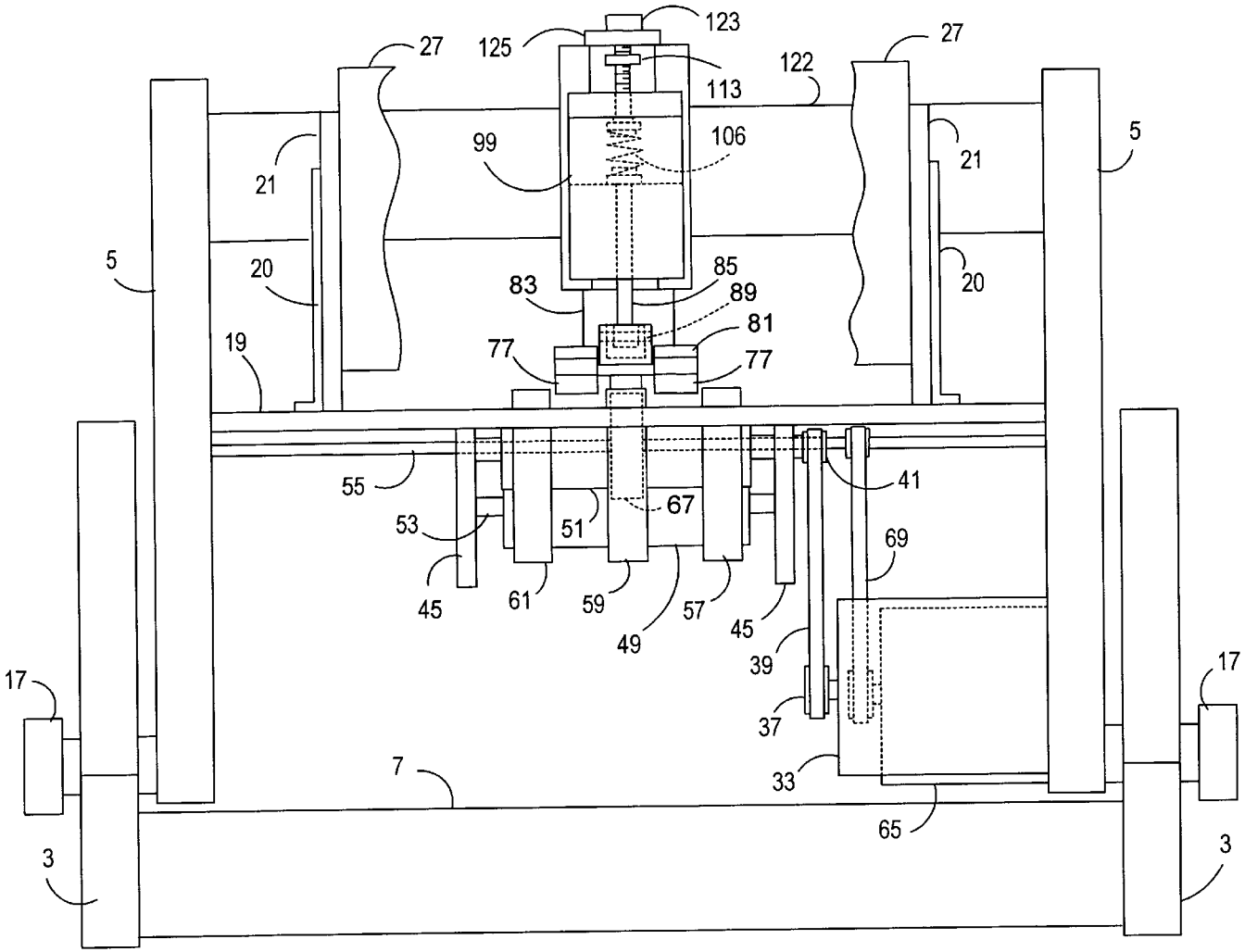
FIG. 2 is an end view of the inventive separator of FIG. 1 taken along the document feed path direction.

FIGS. 1–2 show the inventive separator 1. The separator 1 has a rigid frame made up of two base plates 3 that are rigidly connected to each other via framing members 7. The rigid frame serves as the primary supporting structure (housing) for the remaining components of the separator 1 as discussed further below.

Two sidewalls 5 are pivotally mounted opposite to each other on a common shaft 11 that is mounted in base plates 3. The sidewalls 5 each have a threaded pin 13 extending outward that rides in arced slot 15 of base plates 3 thereby limiting the pivoting movement of the sidewalls 5 relative to base plates 3. A locking mechanism 17 threads onto pins 13 and is used to lock the sidewalls 5 in any desired position along the arced slot 15.

A feed deck 19 is fixedly mounted to the sidewalls 5 and defines a feed path direction represented by the arrow "A". Attached, via supports 20, to the feed deck 19 are guide walls 21 that serve to define a hopper region into which a stack 23 of individual mailpieces 25 are placed prior to separation. A wall 27 mounted between the guide walls 21 serves to shingle the mailpieces 25 as they are fed along the feed path "A" toward a retard mechanism 29 and a feeder 31.

Feeder 31 includes a motor 33 having a shaft 35 with a pulley 37 attached thereto. A drive belt 39 is disposed around the pulley 37 and another pulley 41 mounted on another shaft 43. Motor 33 is mounted to one of the side walls 5 while shaft 43 is mounted for rotation within two flanges 45 extending down from the bottom of feed deck 19. A segmented roller assembly 47 is fixedly mounted to shaft 43 to rotate therewith. Two other roller assemblies 49, 51 are also mounted on respective shafts 53, 55 for rotation. Three feed belts 57, 59, and 61 are disposed around the three roller assemblies 47, 49, and 51. Accordingly, in operation, motor 33 drives belt, 39 into rotation causing roller assembly 47 to rotate in the clockwise direction of FIG. 1. This in turn causes feed belts 57, 59, and 61 to rotate in the clockwise direction over roller assemblies 47, 49, and 51 creating a feeding force "F" along the feed path direction "A" on the bottom mailpiece 25*a*. The feeder 31 is a conventional feeder and one skilled in the art will recognize that other known feeders such as those using rollers instead of belts can be used in used in lieu thereof. Moreover, while three feed belts 57, 59, 61 are shown, other configurations using one or more feed belts may be used in lieu thereof. Additionally, if the sidewalls 5 are pivoted such that the feed deck 19 is positioned at an angle relative to horizontal, an additional feed force component due to gravity assists in feeding the mailpieces 25 toward the retard mechanism 29 is created.

Downstream of the feeder 31 is a conventional take-away roller assembly 63 that includes a drive motor 65 that drives a first take-away roller 67 into rotation via a belt drive 69. Assembly 63 also includes a second take-away roller 71 that is spring loaded via spring 75 but is moveable away from roller 67 via a pivoting link 76 in order to ingest individual mailpieces 25 into the nip formed between the first and second take-away rollers 67, 71. The function of the take-away assembly 63 is to move the individual mailpieces 25 received from the feeder 31 downstream for further processing.

Figure 3:
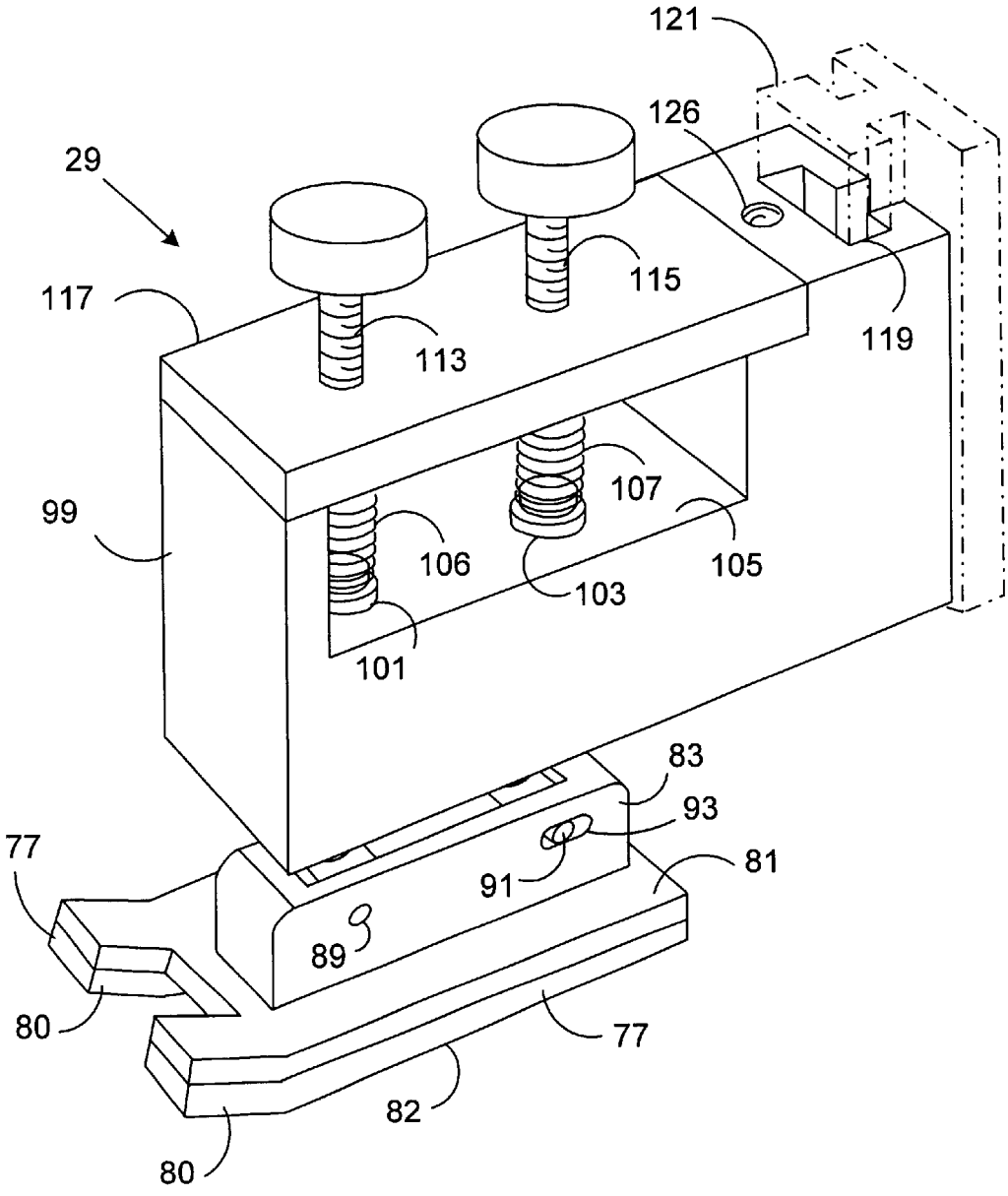
FIG. 3 is an enlarged perspective view of the retard mechanism of the separator of FIG. 1.

The novel retard mechanism 29 is shown in FIGS. 1, 2, and 3 and includes two elastomeric pads 77 that extend down between respective feed belts 57, 59, and 61. The positioning of the pads 77 between the belts 57, 59, and 61 is important in that it creates a corrugation in the mailpieces 25 as they pass between the feeder 31 and the retard mechanism 29. The corrugation of the mailpieces 25 assists in the proper separation of individual ones of the mailpieces 25 from the stack 23. Elastomeric pads 77 each have an angled front portion 80 that performs a pre-shingling of the, mailpieces 25 prior to individual mailpieces 25 contacting a substantially horizontal (can vary up to 30 degrees from horizontal), planar surface 82 of pads 77. As the feeder 31 continues to feed a mailpiece 25 past the angled front portion 80 of pads 77, the top surface of the mailpiece 25 comes into contact with the surface 82. This contact creates a retard force "R" in opposition to the feed force "F". In the case of a single mailpiece 25, the feed force "F" is greater than the retard force "R" such that the mailpiece 25 is fed to the take-away assembly!63. However, when multiple mailpieces 25 are contained between the feed belts 57, 59, 61 and horizontal surface 82, the retard force prevents all but the bottom mailpiece 25*a* from being fed to the take-away assembly 63 as discussed in further detail below.

The elastomeric pads 77 are attached to a metal backplate 81 having a boss portion 83 extending upward therefrom. Boss portion 83 has a cutout therein to receive two shafts 85, 87. Shafts 85, 87 respectively include at a bottom end thereof pin portions 89, 91 running perpendicular to the shafts 85, 87. The boss portion 83 is mounted on the pins: 89, 91 so that it can rotate around either one of the pins 89, 91. Pin 91 however fits into an oversized slot 93 in boss portion 83 to permit the movement of the boss portion 83 as described further below.

Shafts 85, 87 each extend upward through linear bushings 95, 97 contained in a primary housing 99 and limit the extent to which the pads 77 extend down between the feed belts 57, 59, 61. At the top of each shaft 85, 87 are respective flanges 101,103. The flanges 101,103 rest on surface 105 of housing 99. Springs 106,107 are contained between the respective flanges 101, 103 and a corresponding flange 109,111 disposed at the end of adjusting bolts 113,115. As adjusting bolts 113,115 are screwed into a top surface 117 of housing 99 they compress springs 106,107 thereby setting a preload on separator pads 77. Accordingly, as mailpieces 25 pass between the separator pads 77 and the feed belts 57, 59, 61, the initial preload is exerted on the mailpiece 25. Moreover, depending upon the thickness of the mailpiece 25 which causes a resulting upward movement of the shafts 85, 87, the normal force exerted on the elastomeric pads 77 will increase due to the compression of springs 106,107. The increase in the normal force causes a resulting increase in the retard force "R". Accordingly, the retard force "R" exerted by the retard mechanism 29 automatically adjusts to different thickness mailpieces 25. It is to be noted that the structure of FIGS. 1 and 2 provides a distributed load across the surface 82 of elastomeric pad 77.

As previously discussed, the amount of corrugation of mailpieces 25 depends upon the depth at which the bottom surface of pads 77 pass below the top surface of feed belts 57, 59, 61. This depth is set by adjusting the vertical position of housing 99 relative to the feed deck 19. Housing 99 contains a slot 119 that fits around and slides along a slide bracket 121 fixedly mounted to cross-brace 122. An adjusting bolt 123 is contained in a top plate 125 fixedly mounted to slide bracket 122. Bolt 123 is threaded into and out of a corresponding threaded opening 126 in housing 99 thereby respectively raising and lowering housing 99 relative to the feed deck 119.

Figure 4A:
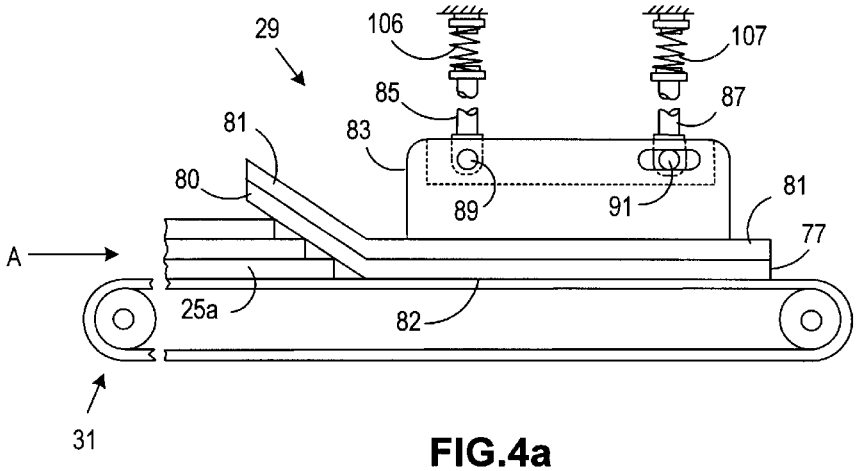
FIGS. 4*a*, 4*b*, 4*c*, and 4*d* show the sequential movement of the inventive separator as a document is processed.
Figure 4B:
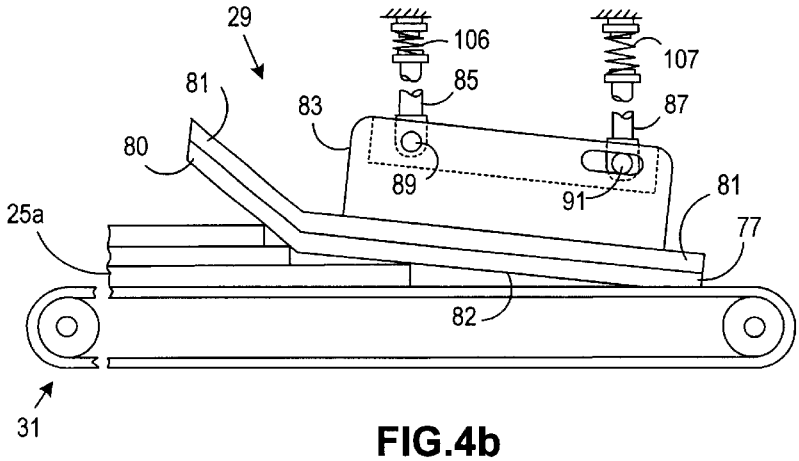

Referring to FIGS. 4*a*, 4*b*, 4*c*, and 4*d*, the operation of the separator 1 will now be described. In FIG. 4*a*, the retard mechanism 29 is in its nominal position relative to the feeder 31 prior to ingestion of the mailpiece 25*a*. In this position, surfaces 82 of pads 77 are substantially horizontal relative to feed path "A" and are positioned between the feed belts 57, 59, 61. The shafts 85, 87 are at their lowest (nominal position) and have a preload exerted on them via respective springs 106, 107. Looking at FIG. 4*b*, the feeder 31 has moved the bottom mailpiece 25*a* beneath the surfaces 82 of pads 77 while the angled portions 80 prevent the other mailpieces 25 from being moved beneath the a,j surfaces 82. Shaft 85 has moved vertically upward from the nominal position of FIG. 4*a* compressing spring 106. In order to accommodate the vertical movement of shaft 85, boss portion 83 rotates in the clockwise direction of FIG. 4*b* around pin 91. In this position, the retard force "R" is less than the feed force "F" such that mailpiece 25*a* moves to the position shown in FIG. 4*c*.

Figure 4C:
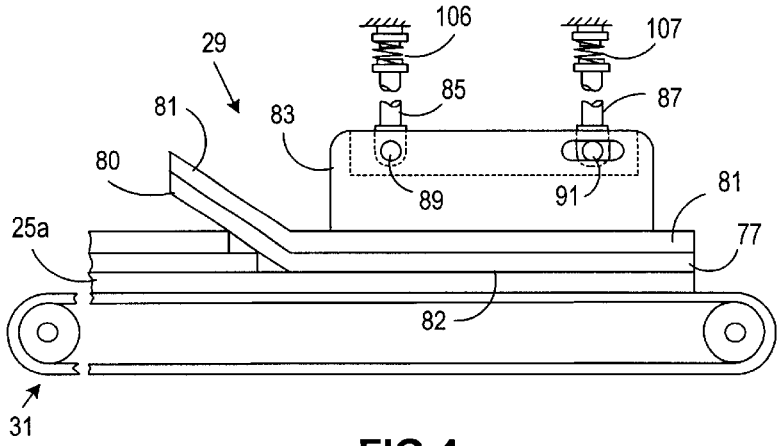

In FIG. 4*c* mailpiece 25*a* is fully ingested the full extent of the surfaces 82 along the feed path "A". Shaft 87 has now moved vertically upward from its nominal position to be substantially even with the position of shaft 85. Accordingly, boss portion 83 has rotated in the counterclockwise direction around pin 89 as it transitions from the FIG. 4*b* position to the FIG. 4*c* position. As the feeder 31 continues to feed mailpiece 25*a* toward take-away assembly 63, it will trigger a sensor (not shown) near the take-away assembly 63. Upon the triggering of the sensor, the feeder 31 is stopped and the take-away assembly 63 pulls the mailpiece 25*a* from the feeder 31 and retard mechanism 29. Alternatively, instead of stopping the feeder 31, the take-away assembly 63 can be driven at a higher velocity than the feeder 31 in order to accomplish the same effect.

Figure 4D:
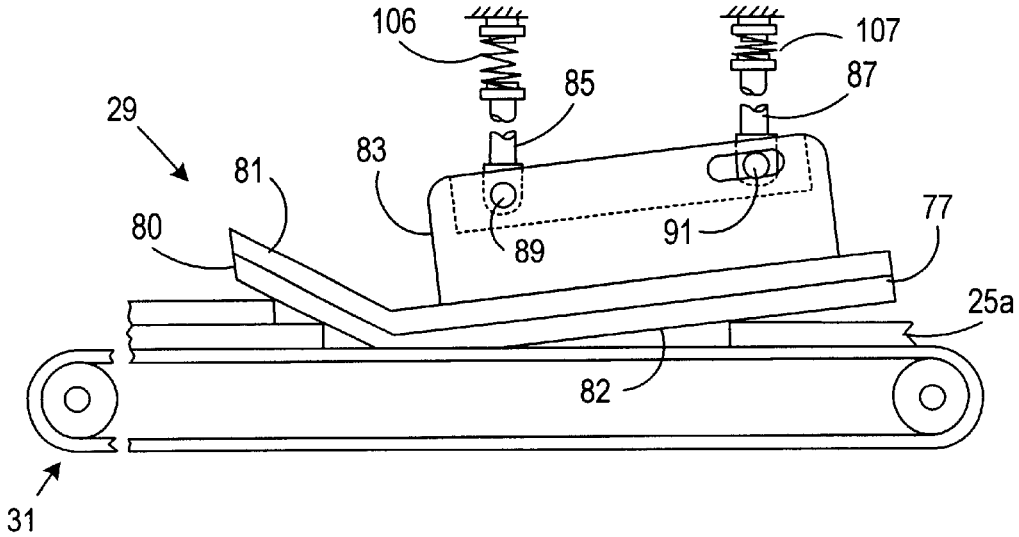

FIG. 4*d* shows the position of the retard mechanism 29 as the mailpiece 25*a* exits. In FIG. 4*d*, shaft 85 has returned to its nominal position while shaft 87 is still in its uppermost position. Thus, in going from the position of FIG. 4*c* to FIG. 4*d*, boss portion 83 has rotated around pin 91 in a counterclockwise direction. Finally, once the mailpiece 25*a* has cleared the feeder 31 and retard mechanism 29, the boss; portion 83 rotates in the clockwise direction around pin 89 to return to the position of FIG. 4*a* where the process starts over again to feed the next mailpiece 25.

Figure 5:
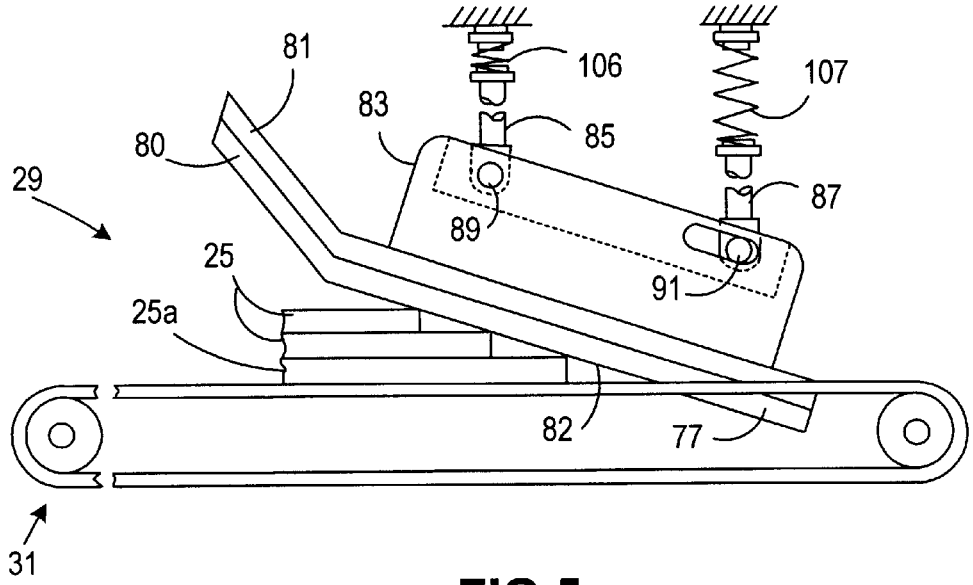
FIG. 5 shows the orientation of the retard mechanism when a document multi-feed situation occurs.

FIG. 5 shows how the retard mechanism 29 separates an individual mailpiece 25*a* when a plurality of mailpieces 25 have been ingested beneath surface 82 of pad 77. Since the retard mechanism 29 moves vertically upward and rotates along the feed path "A" as discussed above, it will assume the position shown in FIG. 5 when multiple mailpieces 25 are ingested between the feeder 31 and the retard mechanism 29. Accordingly, each of the mailpieces 25 makes contact with the surfaces 82 of pads and is subjected to the retard force "R". However, only the bottom mailpiece 25*a* is subject to the feed force "F" which is greater than the retard force "R". The other two mailpieces on their bottom sides are subjected to inter-document feed forces which are less that the retard force "R". Accordingly, the top two mailpieces 25 are not fed together with the bottom mailpiece 25*a*. The pad 77 stays in the position shown in FIG. 5 continuously feeding each new bottom mailpiece 25*a* until the multi-feed situation is cleared. Once cleared, the retard mechanism 29 returns to the position of FIG. 4*a*.

Figure 6A:
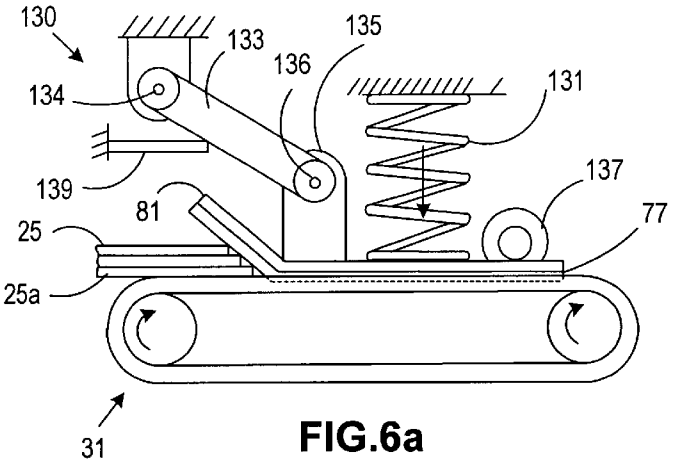
FIGS. 6*a*, 6*b*, 6*c*, and 6*d* show the sequential movement of a second embodiment of a retard mechanism as a document is processed.
Figure 6B:
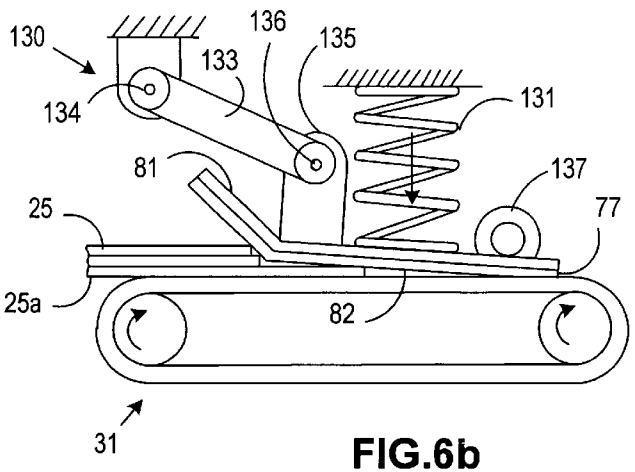
Figure 6C:
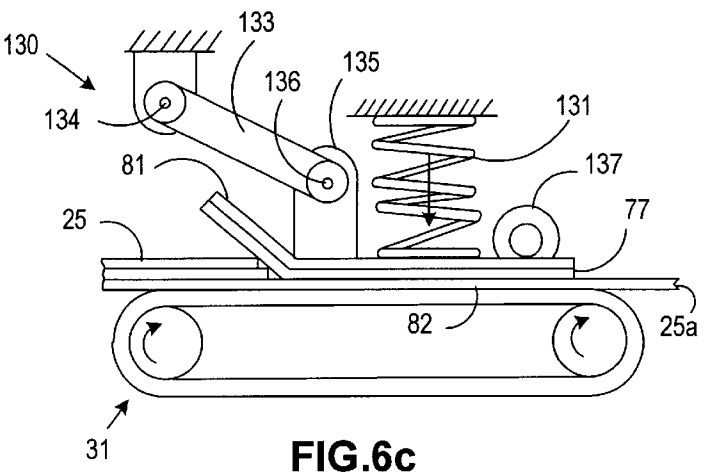
Figure 6D:
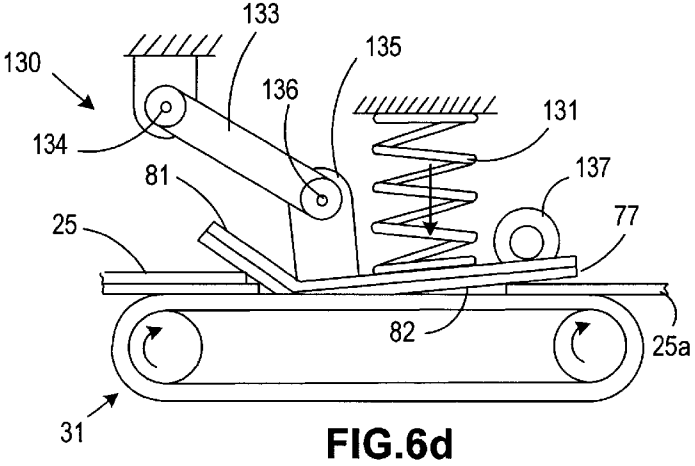

FIGS. 6*a*, 6*b*, 6*c*, and 6*d* show an alternate embodiment of a retard mechanism which is shown at 130. Referring to FIG. 6*a*, a single large spring 131 is used in lieu of two separate springs in order to provide the distributed load to pads 77. Moreover instead of the shafts 85, 87 a linkage assembly is used to achieve the desired vertical and rotational movement of pads 77. A first link 133 is pivotally connected to ground at one end 134 and pivotally connected to boss portion 135 at its other end 136. Boss portion 135 is fixedly mounted to plate 81. Moreover, there is a nose wheel 137 mounted for rotation in plate 81. Nose wheel 137 comes into contact with belt 59 of feeder 31 thereby setting the corrugation depth of pads 77 at the end nearest the nose wheel 137. A fixed member 139 abuts against link 133 to set the corrugation depth at the other end of pads 77.

In operation, FIGS. 6*a* to 6*d* are similar to FIGS. 4*a* to 4*d* in that pad 77 first rotates in the clockwise direction around the nose wheel 137 (FIG. 6*b*) as it ingests the mailpiece 25*a* beneath surface 82. The boss portion 135 moves upward forcing link 133 to pivot in the counterclockwise direction about pivot 134. As the mailpiece 25*a* is fully ingested (moving:from position of FIG. 6*b* to FIG. 6*c*), pads 77 have rotated in the counterclockwise direction about pivot 136. Then as, mailpiece 25*a* leaves the retard mechanism (FIG. 6*d*) the pads 77 rotate around nose wheel 137 in the counterclockwise direction. Thus, the basic movement of pads 77 is essentially the same as in FIGS. 4*a*–4*d*. However, since the embodiment shown in FIGS. 6*a*–6*d* do not prevent movement of the pad 77 along the feed path "A" (whereas this movement is prevented in the FIG. 4 structure) there is a small amount of movement of pad 77 along the feed path "A". This movement may assist with the separating ability of the retard mechanism 130.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example, the pad 77 may be a single pad or a plurality of pads other than 2. Additionally, the pads 77 can be any material that provides the friction properties needed to effectively accomplish the separating function of the retard mechanism. For example, separation stones can be used.

What is claimed is:

1. A separator comprising:

a housing;

a feeder mounted in the housing, the feeder feeding documents along a feed path;

a retard mechanism mounted in the housing along the feed path and opposite to the feeder, the retard mechanism including a body and a pad attached to the body, the body mounted at first and second pivot points such that the body and pad can rotate around the first and second pivot points;

a biasing device that applies a distributed load along the pad, and wherein at times when a document is not present in the feed path between the pad and the feeder the biasing mechanism maintains the pad in a first position substantially parallel to the feed path, and at times when the document is being fed along the feed path between the pad and the feeder the body and the pad first rotate around the first pivot point and then rotate around the second pivot point to reach a second position whereby the pad is substantially parallel to the feed path but disposed from the first position by the thickness of the document.

2. A separator as recited in claim 1, wherein the body and pad are mounted for movement along the feed path at times when the feeder feeds the document between the feeder and the retard mechanism.

3. A separator as recited in claim 1, further comprising first and second shafts and a shaft frame, and wherein the first and second shafts are respectively connected to the body at the first and second pivot points and are mounted in the shaft frame for movement only in a direction perpendicular to the feed path.

4. A separator as recited in claim 3, wherein the biasing mechanism includes first and second springs disposed respectively between the first and second shafts and the shaft frame.

5. A separator as recited in claim 4, wherein the shaft frame is movably mounted to the housing for movement perpendicular to the feed path.

6. A separator as recited in claim 5, wherein the pad is an elastomeric pad.

7. A separator as recited in claim 1, further comprising a link pivotally mounted to the housing at a first end and pivotally mounted at a second end to the body at the second pivot point, and a nose wheel pivotally mounted to the body at the first pivot point.

8. A separator as recited in claim 7, wherein the biasing mechanism is a spring disposed between the first and second pivot points and captured between the housing and the body.

9. A separator as recited in claim 6, wherein the feeder includes a plurality of driven feed belts and the elastomeric pad includes first and second extending portions that are each disposed between different ones of the plurality of feed belts and extend past the feed belts by a predetermined distance at times when the document is not disposed between the retard mechanism and the feeder.

10. A separator as recited in claim 9, wherein the predetermined distance is within a range from about 0.5 mm to about 3 mm.

11. A retard mechanism as recited in claim 1, further comprising a biasing device that applies a distributed load along the pad, and wherein at times when a mailpiece is not present in the feed path between the pad and the feeder the biasing mechanism maintains the pad in a first position substantially parallel to the feed path, and at times when the mailpiece is being fed along the feed path between the pad and the feeder the body and the pad first rotate around the first pivot point and then rotate around the second pivot point to reach a second position whereby the pad is substantially parallel to the feed path but disposed from the first position by the thickness of the mailpiece.

* * * * *